US005701926A

United States Patent [19]

Luisi

[11] Patent Number: 5,701,926

[45] Date of Patent: Dec. 30, 1997

[54] BACKFLOW PREVENTION DEVICE AND VACUUM BREAKER FOR KITCHEN PLUMBING

[75] Inventor: Domenic Luisi, Schomberg, Canada

[73] Assignee: The Rubinet Faucet Company, Woodbridge, Canada

[21] Appl. No.: 478,795

[22] Filed: Jun. 7, 1995

[51] Int. Cl.[6] ..... E03C 1/10

[52] U.S. Cl. ..... 137/218; 137/801

[58] Field of Search ..... 137/218, 801

[56] References Cited

U.S. PATENT DOCUMENTS

| | | | |
|---|---|---|---|
| 3,144,873 | 8/1964 | Moore et al. . | |
| 4,553,560 | 11/1985 | Tucker et al. | 137/218 |
| 4,589,438 | 5/1986 | Breda | 137/218 |
| 4,609,006 | 9/1986 | Parkison et al. | 137/119 |
| 4,922,943 | 5/1990 | Gill | 137/1 |
| 4,953,585 | 9/1990 | Rollini et al. | 137/218 |
| 4,977,920 | 12/1990 | Oberdorfer | 137/218 |
| 5,009,247 | 4/1991 | Oberdorfer | 137/218 |
| 5,022,429 | 6/1991 | Rollini et al. | 137/218 |
| 5,079,781 | 1/1992 | Gnauert et al. | 137/218 X |
| 5,095,554 | 3/1992 | Gloor | 137/218 X |
| 5,121,509 | 6/1992 | Juple | 4/669 |
| 5,163,465 | 11/1992 | King, Sr. | 137/218 |
| 5,213,131 | 5/1993 | Gnauert | 137/218 |
| 5,213,268 | 5/1993 | Gnauert et al. | 137/218 X |
| 5,217,040 | 6/1993 | Hochstrasser | 137/218 |
| 5,285,808 | 2/1994 | Clanin | 137/114 |
| 5,305,778 | 4/1994 | Traylor | 137/216 |
| 5,404,898 | 4/1995 | Stowers | 137/218 |

FOREIGN PATENT DOCUMENTS

| | | |
|---|---|---|
| 1225006 | 8/1987 | Canada . |
| 2676530 | 11/1992 | France . |

OTHER PUBLICATIONS

Ritland, Robin L., "Backflow Prevention: Theory and Practice" 1990, pp.: 47–71, 79–81, 83, 91–103, 118–119, 126–132, and 206–215.

*Primary Examiner*—Gerald A. Michalsky

*Attorney, Agent, or Firm*—Lieberman & Brandsdorfer, LLC

[57] ABSTRACT

A back flow prevention device and/or vacuum breaker device for mounting on a plumbing fixture. The device comprises a body having fluid entry means, fluid exit means and backflow prevention means. The backflow prevention means is located between the fluid entry means and the fluid exit means and the backflow prevention means comprises, a chamber having an entry port contiguous with the fluid entry means, an exit port contiguous with the fluid exit means and a back flow prevention port which is open to atmospheric pressure and a valve movably mounted between a first position sealing the entry port and a second position sealing the backflow prevention port. Fluid flowing into the chamber moves the valve out of the first position into the second position thereby allowing fluid to freely flow through the chamber, out the exit port and along the fluid exit means. The valve, in the absence of fluid flow along the fluid entry means, returns to its first position thereby leaving the backflow prevention port open to atmospheric pressure to prevent backflow and to permit vacuum breakage.

9 Claims, 4 Drawing Sheets

BACKFLOW PREVENTION DEVICE AND VACUUM BREAKER FOR KITCHEN PLUMBING

FIELD OF THE INVENTION

This invention relates to backflow prevention and vacuum breaking devices used in plumbing systems to prevent backflow and backsiphoning of contaminated water into the potable water supply. More particularly, the present invention relates to backflow prevention devices and vacuum breaker devices in kitchen plumbing systems.

BACKGROUND OF THE INVENTION

Backflow prevention devices and vacuum breaker devices are useful in preventing the backflow of contaminated water into a potable water supply. Such devices are known for use in various types of household and industrial plumbing installations. They are known, for example, for use in bidets, food processing facilities, dishwashers, tubs and showers. Contaminated water is considered to be any water downstream of the faucet head. Examples of possible contaminants include bacteria, or other pathogenic organisms, toxic chemicals or environmental pollutants.

Backflow prevention is of exceptional importance in the area of public health. Sinks, basin, tubs and other repositories for tap water can be used for many purposes resulting in contamination of the water. It is known that vacuums can be created in any water distribution system thereby creating opportunities for contaminated water, or other pollutants or toxins, to be siphoned back into the clean, potable water distribution system and leaving the potable water supply at risk of possible systemic hazardous conditions.

It is known that when a tap is turned off a vacuum can develop along the water pipes. If a spray head is left resting in dirty water then this dirty water could flow backwards into the pipes and contaminate the clean water supply. To comply with recently amended government standards it is now required that a back flow prevention device be mounted in any of the flex hose plumbing systems used in kitchen sinks, for example.

The maintenance of a fresh water supply in any public water distribution system is essential to the integrity of the system. To address the health hazards arising out of backflow conditions, laws have been enacted to prohibit backflow and cross-connections. To maintain high standards, government agencies continue to regulate the installation of plumbing devices adding further requirements for preventive controls. Most recently standards have been developed by the Canadian Standards Association (CSA) for kitchen sink installations. Standards differ from country to country but many countries appear to be moving towards continuing safeguards being implemented to prevent backflow in plumbing systems.

To prevent backflow of contaminated water into the potable water supply, it is necessary to incorporate a vacuum breaker or a backflow prevention means, or both, into the plumbing fixture to gain CSA or other standards approval for faucets, valves and other aspects of plumbing fixtures. In addition to the different state, provincial and federal regulations present in Canada and in other countries, there are also plumbing codes and independent standards authorities with which one must comply.

The requirement for backflow prevention devices in standard household sinks creates a need for a backflow prevention device which complies with standards yet is simple to manufacture and install. It should be durable and available at a reasonable cost. A reliable device with a minimum of moving parts is key to the durability and success of such products.

When the pressure on the non-potable water source is greater than the pressure present in the potable water source back pressure occurs. This could occur, for example, in times of heavy water use. Backsiphonage is the term used when the supply line pressure falls below atmospheric pressure (see "Backflow Prevention: Theory and Practice " by Robin L. Ritland; Kendall/Hunt Publishing Company, Iowa, at page 3).

Normally, the potable water supply flows in one direction: towards the faucet from which the water pours out. Backflow is a reversal of this normal flow direction. Backflow, of which backsiphoning is one example, is caused by one or more cross-connections in one or more pipelines. The cross-connections can be either direct or indirect. If negative pressure is created along one line then the differential pressure will cause water from another part of the system to flow back into the line intermingling with the existing water supply.

An example of an indirect cross-connection is a kitchen spray nozzle faucet on a goose neck or hose handle. If the spray head is left lying in the sink an indirect cross-connection is created thereby linking the potable water system to any contaminants or pollutants that may be present in the sink. Once the potable water supply is so linked to a non-potable water supply (or other contaminant or pollutant) a connection is formed that permits the flow of water from one source to the other and back, depending on the differential pressure.

A cross-connection is generally defined as any physical arrangement whereby a public water supply is connected, directly or indirectly, with any other water supply which may contain contaminated water, sewage, waste or liquid of unknown or unsafe quality.

To prevent public health hazards, backflow prevention devices must be put in place to prevent backflow into the potable water supply effectively bypassing initial water-treatment processing. Although low levels of disinfectants may still be present in the potable water supply (chlorine and chloramines) these will quickly be used up. Even with dilution, a toxic hazard may remain. The severity of the hazard will vary depending on the toxicity of contaminant involved, when it is detected end the susceptibility of exposed individuals.

There remains a present and ongoing need for secure, reliable, yet simple backflow prevention devices and vacuum breakers in kitchen plumbing systems.

SUMMARY OF INVENTION

The present invention concerns a self-contained backflow prevention device and/or vacuum breaker device, mountable in a standard plumbing fixture such as a household sink, to prevent backflow and/or break vacuum. According to a preferred embodiment, the backflow prevention means and vacuum breaker means of the present invention relates to installations for kitchen sinks.

According to an aspect of the present invention, a device for mounting on a plumbing fixture is provided. The device comprises a body having fluid entry means, fluid exit means and backflow prevention means, the backflow prevention means being located between the fluid entry means and the fluid exit means, the backflow prevention means comprising, a chamber having an entry port contiguous with the fluid entry means, an exit port contiguous with the fluid exit means and a back flow prevention port which is open to atmospheric pressure; and a valve movably mounted between a first position sealing the entry port and a second position sealing the backflow prevention port;

wherein fluid flowing into the chamber moves the valve out of the first position into the second position thereby allowing fluid to freely flow through the chamber, out the exit port and along the fluid exit means, and wherein the valve, in the absence of fluid flow along the fluid entry means, returns to its first position thereby leaving the backflow prevention port open to atmospheric pressure to prevent backflow.

Other and further advantages and aspects of the present invention will become more apparent to those skilled in the art in view of the following description and the accompanying drawings.

BRIEF DESCRIPTION OF THE DRAWINGS

For the purpose of illustrating the invention, there is shown in the drawings a form which is presently preferred. It is to be understood that the invention is not intended to be limited to the precise arrangements and instrumentalities shown.

DETAILED DESCRIPTION OF THE PREFERRED EMBODIMENTS

An embodiment of the invention will now be described with reference to the drawings wherein like numerals refer to like part.

A focus of the present invention is to provide a cost effective means of complying with new standards for kitchen plumbing fixtures. It is advantageous that the vacuum breaker device and/or backflow prevention device of the present invention is readily adaptable to many plumbing fixtures. It fits easily under the escutcheon plate of the faucet body and can be easily removed for repair or replacement. By minimizing the number of moving parts durability is enhanced. With current standards in place, these are important advantages since all contractors will have to be able to comply with the standards in an efficient and cost effective manner without sacrificing quality.

A person with basic skill in the art would understand that the device of the present invention would save to operate as a vacuum breaker when needed or as a backflow prevention device when needed, or as both if required. Therefore the cartridge (31) is referred to herein as either a vacuum breaker cartridge, a backflow prevention cartridge or a vacuum breaker/backflow prevention cartridge.

Spray nozzle extension hoses, often provided in kitchen sinks, have a flexible hose allowing the spray head to be removed from its mounted position and be used in moveable fashion. If the user fails to return the spray head to its mounted position then the flex hose is long enough that the spray head could accidentally be left lying in the sink. At any time when the spray head is left resting in the sink the head could be exposed to unclean water. This indirect cross-connection creates the opportunity for contaminants or pollutants in the sink, perhaps soapy water, to backflow into the potable water system if backsiphonage conditions exist.

The present invention provides a backflow prevention device for preventing backflow of dirty water into the potable water supply and thereby preventing contamination of the clean water supply. This is accomplished in two ways. A valve housed within a backflow prevention cartridge is normally seated over the entry port into the chamber which contains the valve. This provides a seal against preventing backflow water from entering the potable water supply. Secondly, the chamber is exposed to ambient pressure and temperature conditions through a backflow prevention port which vents the chamber to the normal atmosphere. Both of these aspects act singly and in combination to break any vacuum that develops along the water supply lines and to prevent the introduction of contaminated water into the potable water supply. The present invention also has the additional advantage of eliminating any pockets of contaminated water that may flow back out of the tap when the tap is turned on since contaminated water can be vented outside of the system.

Figures 1, 1A:
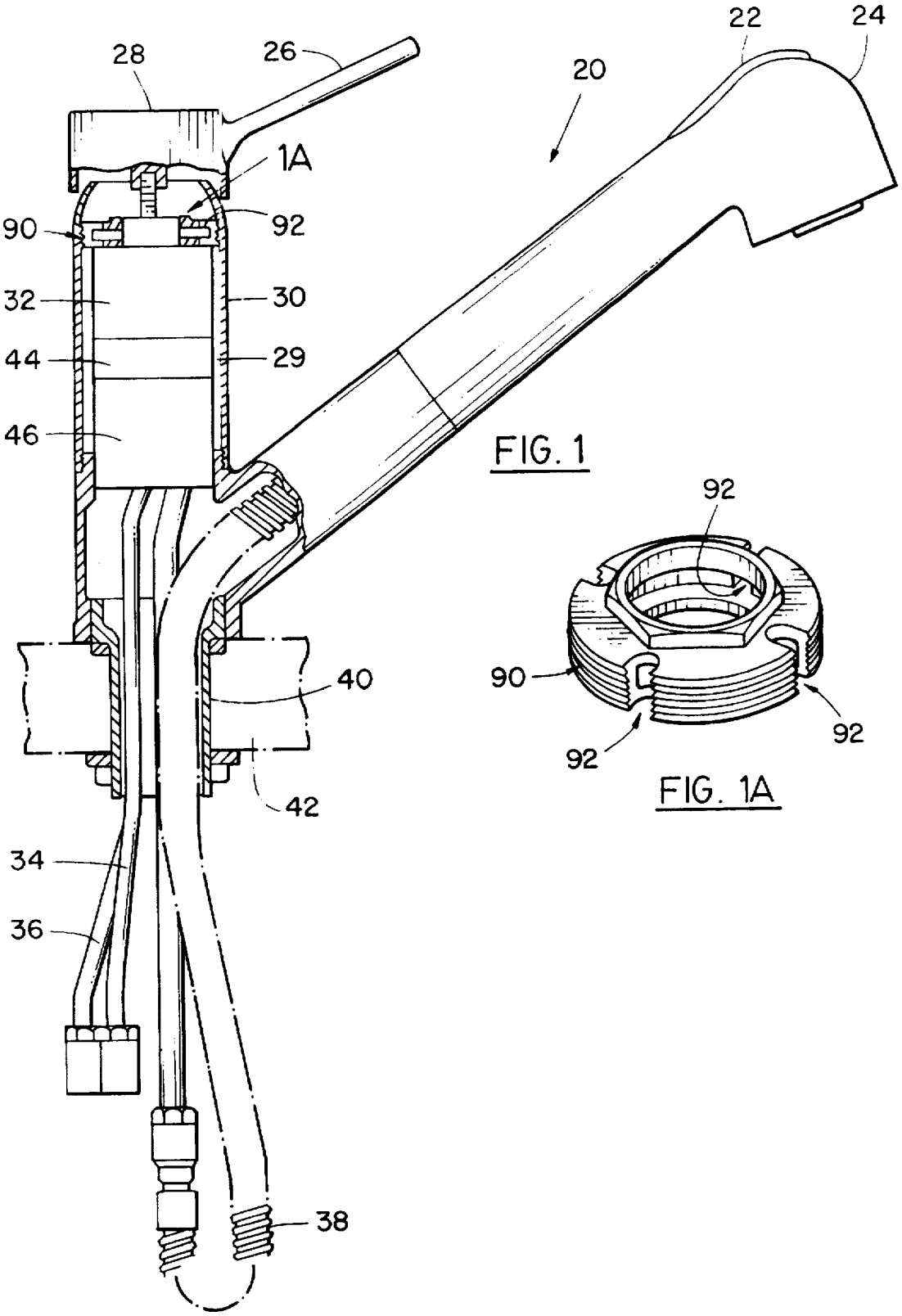
FIG. 1 is a simplified elevation perspective view in part section of the main assembly of one of a sink plumbing fixture, illustrating the backflow prevention device of the present invention positioned therein.
FIG. 1A is an enlarged view of a lock nut illustrating the openings in the lock nut which allow passage of atmospheric air pressure into the housing.

Referring now to the drawings, FIG. 1 illustrates an assembly (20) of a typical kitchen faucet. A hand spray control (22) may be located on the spray head (24). The faucet has an on/off, volume control handle (26), a snap-on handle cap (28) and an escutcheon plate housing (30), all of which would typically be made of a suitable metal and reflect one type, amongst many, of kitchen plumbing fixture. A volume control and water mixing cartridge (32) is located underneath the escutcheon housing (30) and is seated on a two-piece backflow prevention/vacuum breaker cartridge (31). In this position, the mixing cartridge (32) and the vacuum breaker (31) readily and easily accessible underneath the snap-on handle cap (28). The mixing cartridge (32) is a standard piece that can be purchased from a plumbing supply store.

The mixing cartridge (32) and the vacuum breaker/backflow prevention cartridge are housed loosely under the escutcheon plate housing (30). The cartridges (31, 32) are exposed to atmospheric air pressure because the fitting escutcheon plate housing leaves an air space (29) between the housing (30) and the cartridges (31, 32) and because the locking nut (90), which secures the housing and the cartridge in place, contains openings (92) thereby allowing atmospheric air into the housing where it can circulate around the cartridges (31, 32) housed therein. Although there is an air space between the housing and the cartridges, the later do not move because of structural constraints which are present and which are described in further detail below.

Hot water and cold water enter into mixing cartridge (32) via the hot water pipe (34) and the cold water pipe (36). Note that in this particular embodiment the hot and cold water pipes extend through the backflow prevention cartridge. The hot and cold water mixes in the mixing cartridge (32) before it is dispensed back into the backflow prevention cartridge (31) to ultimately exit out of the spay head (24) via, for example, flexible goose-neck tubing (38). A threaded mounting portion (40) permits the assembly to be mounted on a cabinet (42).

In FIG. 1, the mixing cartridge (32) can be seen, in the cut-away view, sitting on top of the vacuum breaker cartridge (31). The mixing cartridge (32) is positioned on top of the vacuum beaker cartridge (31) by way of positioning pins (75 and 77) on the bottom of the mixing cartridge (32). The positioning pins (75, 77) slide snugly into openings (74 and 76) provided in the upper portion (44) of the vacuum breaker cartridge (31).

Figure 2:
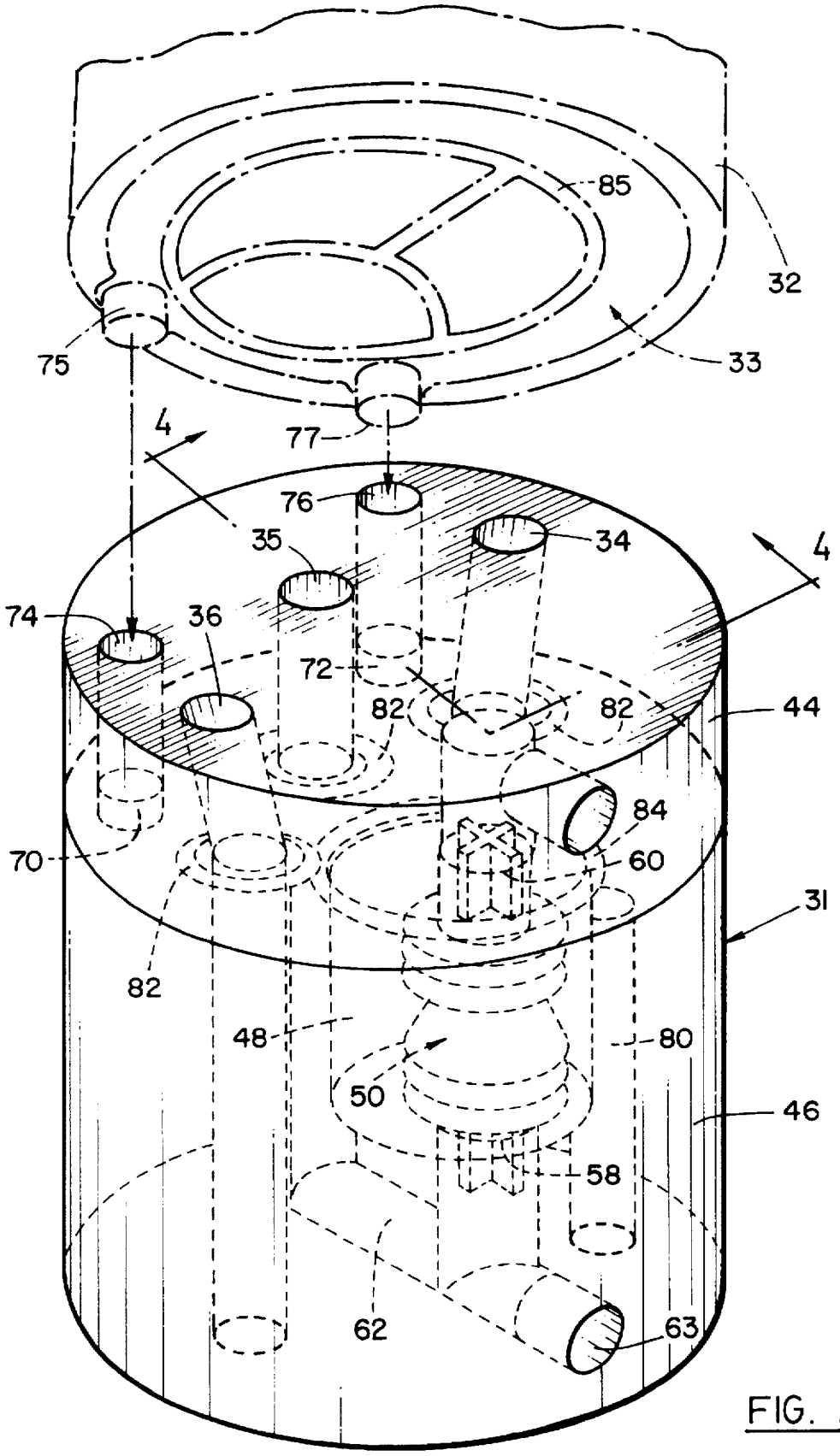
FIG. 2 is a perspective view of an embodiment of the backflow prevention device of the present invention illustrating main passageways, illustrating the float valve in its chamber and showing in exploded detail, the bottom of the mixing cartridge and the orientation of the mixing cartridge for mounting.

FIG. 2 illustrates a preferred embodiment of the vacuum breaker cartridge (31) of the preset invention. The cartridge has an upper portion (44) and a lower portion (46). The upper present invention (44) is removable from the lower portion (46) revealing a valve chamber (48) contained within lower portion (46). This is a preferred embodiment of the vacuum breaker/backflow prevention device of the present invention. There need not be two portions, upper and lower, although this arrangement facilitates valve replacement, if necessary. Generally, the invention is a body, mountably connected to a plumbing system. The body has a fluid entry means, a fluid exit means and a backflow prevention/vacuum breaker means therebetween.

Figure 3:
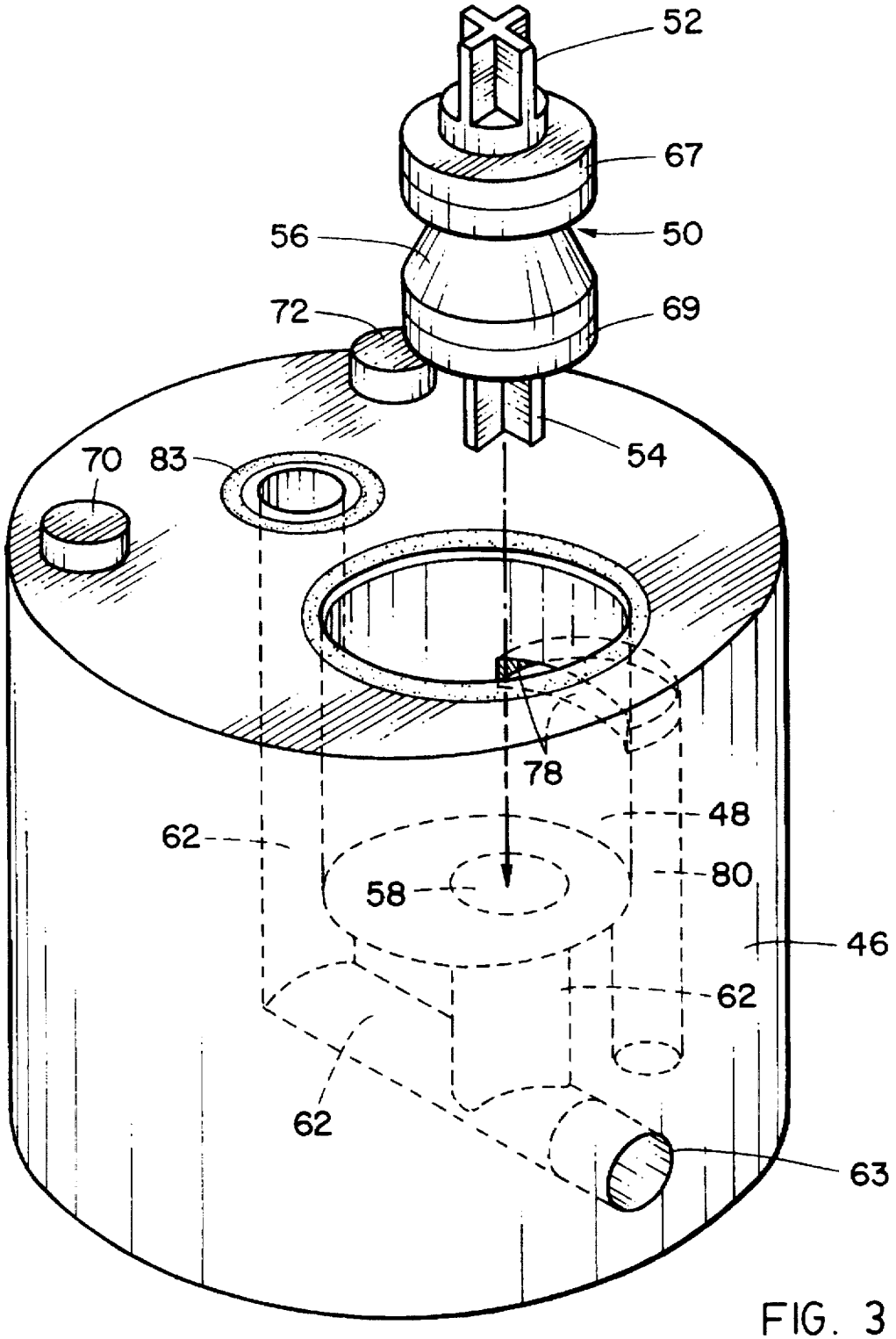
FIG. 3 is a simplified view of the lower portion of the backflow prevention/vacuum breaker cartridge providing an exploded yield of the float valve and the positioning of the float valve in the device. Some passageways have been omitted for clarity.

FIG. 3 illustrates the lower portion (46) when the upper portion (44) has been removed. Some of the passageways (illustrated in FIG. 2) have been omitted from FIG. 3 for greater clarity of the valve chamber (48). A float valve (50) sits within the valve chamber (48). The valve (50), positioned within the chamber (48), is illustrated in FIG. 2. The valve (50) is also illustrated in an exploded view in FIG. 3.

The chamber (48) has entry and exit ports (58 and 78) as defined by the normal flow direction of the potable water. Water flows into the cartridge (32) by a fluid entry means such as a passageway (62) and the fluid entry passageway ends at the chamber (48) by way of the entry port opening (58).

In a preferred embodiment, the float valve (50) is roughly spool-shaped. In this embodiment, the valve (50) is shaped with narrower upper and lower ends, 52 and 54 respectively, than the central body portion (56) of the valve. The narrower ends (52 and 54) project into, and are freely able to move within, openings into the chamber (48). One opening is at the base of the chamber (48) and is referred to as the entry port (58). At the top of the chamber, positioned above the entry port (58) is another opening which will be referred to as the backflow prevention port (60).

By sitting the float valve (50) such that narrower ends (52 and 54) rest movably in entry port 58 and backflow prevention port 60, the valve (50) stands substantially vertical. The valve therefore remains aligned within the normal fluid flow path and is free to travel between the lower end and upper valve seat positions in response to changes in fluid flow direction and atmospheric pressure.

The valve (50) sits substantially vertically between the entry port (58) and the backflow prevention port (60). The entry port (58) is where water flowing along a fluid entry means, such as the fluid entry passageway (62) illustrated in FIGS. 2, 4 and 5, enters into the chamber (48). The fluid entry passageway (62) is plugged or sealed at one end (63) where it turns to continue upwards to open into the chamber (48). The backflow prevention port (60) connects to an atmospheric pressure connection means such as the backflow prevention passageway (64) illustrated in FIG. 4 and 5.

The ports 58 and 60 may have means for sealing against the upper and lower seats (66 and 68) of the central body (56) of the valve (50). The preferred sealing means include O-rings usually made of silicone or rubber which will allow free passage of fluid when the valve (50) is unseated and will prevent leakage when the valve (50) is seated. This embodiment is not illustrated. Alternatively, the sealing means, also preferably O-rings usually made of silicone or rubber, may be present on the upper and lower seats (66 and 68) of the valve (50). This embodiment is illustrated as O-rings 67 and 69 in FIGS. 4 and 5.

It is necessary that effective sealing occur when upper or lower seats (66 and 68) are in contact with the entry port (58) or backflow prevention port (60), respectively. The sealing means ensure that when water is flowing in the normal direction the valve is pushed up and the backflow prevention port (60), at the top of the chamber (48), is sealed to fluid flow to the outside of the assembly. If any back-flow occurs, the valve will be seated against the entry port (58) by the force of the water and the atmospheric pressure present such that contaminants or pollutants present in the backflow water are not introduced into the potable water supply.

The preferred spool-shape embodiment of the float valve (50) is selected to facilitate water flow around it, with the narrow ends (52 and 54) preferably formed in the shape of a star or a cruciform although other patterns or shape that facilitate fluid flow would also be operable. This shape facilitates the water or air to initiate movement of the valve (50) from one position to the other, substantially ensuring that it does not get stuck as a result of adhesion between surfaces, a circumstance which may be more likely to occur if the narrow ends (52,54) of the valve (50) were formed a solid rectangular-shaped piece. In a preferred embodiment, the valve (50) is preferably made of a plastic material such as ABS, the section of material being based on the requirement that it be hard and light. Obviously the valve (50) is very inexpensive and simple to manufacture. The shade of the valve (50) is preferably designed such that operation of the valve is smooth and reliable.

The upper portion (44) of the backflow prevention cartridge (31) is positioned on the lower portion (46) by positioning pins (70 and 72). In a preferred embodiment the positioning pins are made of the same material as the cartridge and are integral with the lower portion (46) of the backflow prevention cartridge (31). Openings 74 and 76 in the upper portion (44) allow the upper portion (44) to be mounted in alignment over the lower portion (46) and also allows the mixing cartridge (32) to be positioned on top in correct orientation.

O-rings (82), or other suitable sealing means, are present where passageways 34, 62 and 36, cross from the upper portion (44) to the lower portion (46). Another O-ring (84)

seals the rim of the upper edge of the chamber (48). This prevents any leakage of water as the water flows through the backflow prevention cartridge (31). Fluid entry opening (35) is the entrance to passageway (62) which is the passageway into which the mixed hot and cold water flows into the backflow prevention cartridge (31).

The mixing cartridge (32) is also positioned by way of openings 74 and 76 on the upper portion (44). On the bottom surface (33) of the mixing cartridge, positioning pins 75 and 77 located. These pins orient the mixing cartridge so that it sits snugly on top of upper portion (44). Understandably 74 and 76 are long enough to accommodate positioning pins 75, 77 and 70, 72 respectively. Conversely, the positioning pins (70, 72, 75, 77) are not so long as to interfere with the upper portion (44) sitting snugly over lower portion (46). The necessary overall result is that the mixing cartridge (32), the upper portion (44) and lower portion (46) fit snugly together without leakage therebetween. To ensure that leakage is minimized other sealing means, such as a silicon or rubber ring (85), are placed between the bottom (33) of mixing cartridge (32) and the top of upper portion (44). These parts are further secured by the pressure exerted by a lock nut (90).

In the present invention, the cartridge (31, 32) are positioned in the midst of the path of the potable water supply inflow. In this particular embodiment, the backflow prevention cartridge (31) is positioned to receive the potable water after hot and cold mixing. One skilled in the art would be aware of other variants, modifications and equivalents whereby the mixing of hot and cold water occurred elsewhere.

Figure 5:
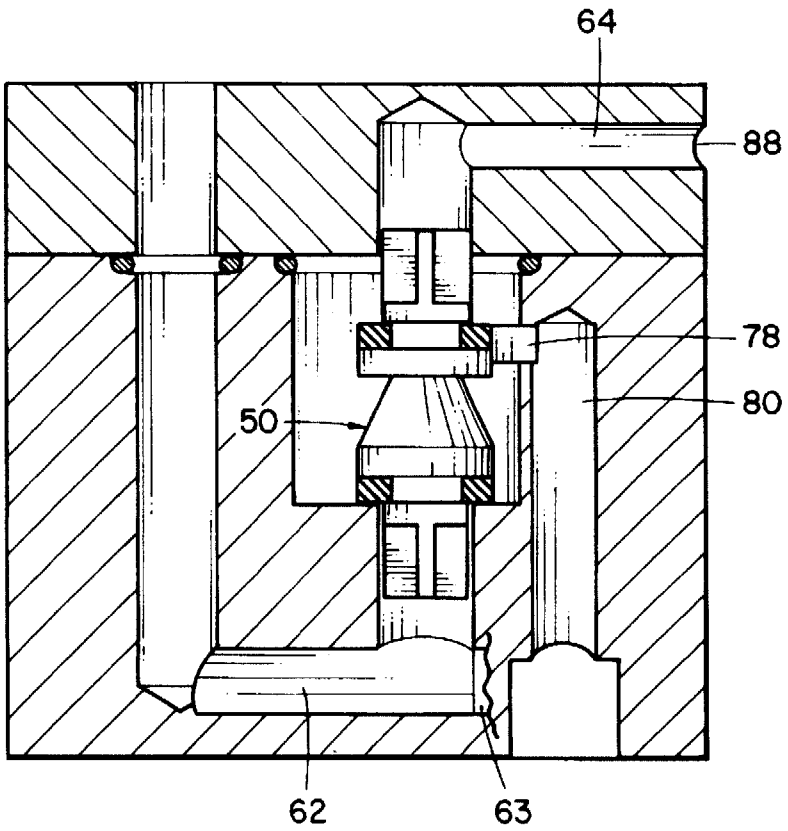
FIG. 5 illustrates a composite cross section through the cartridge, taken on a right angle along the vertical axis of the float valve, approximately in accordance with the arrows "4–4" of FIG. 2 to illustrate the passageway of a preferred embodiment and the positioning of the float valve when the water has been turned off and is not flowing through the system. Some passageways have been omitted for clarity.
Figure 4:
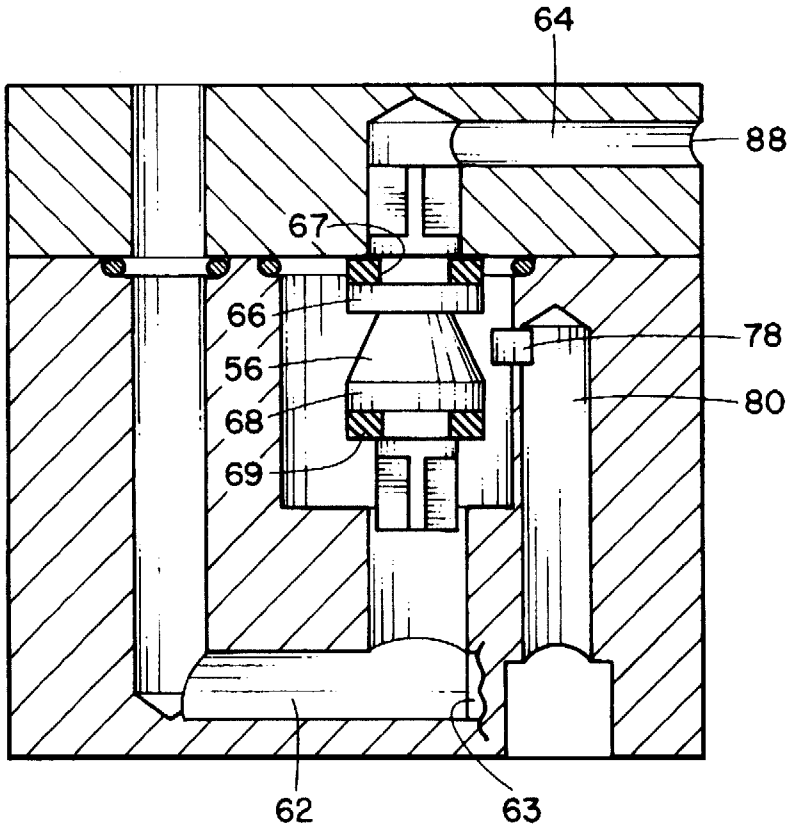
FIG. 4 illustrates a composite cross section through the backflow prevention/vacuum breaker cartridge, taken on a right angle along the vertical axis of the float valve, approximately in accordance with the arrows "4—4" of FIG. 2 to illustrate the passageways of the preferred embodiment and the positioning of the float valve when the water has been turned on and is flowing through the system as shown by the directional arrows. Some passageways have been omitted for clarity.

The chamber (48) also has a fluid exit means, such as fluid passageway 80 illustrated in FIGS. 2, 4 and 5, which opens into the chamber (48) via an exit port (78). When the tap is turned on, water flows normally through the chamber (48) entering via the entry port (58) and exiting by way of the exit port (78).

The exit port (78) is located higher up in the chamber (48) positioned in the side wall. One embodiment, is illustrated in FIG. 4 and 5. The fluid exit means is contiguous with this exit port (78). The fluid exit means includes any suitable means for directing the fluid flow to the faucet spray head. In FIG. 3, for example, this is illustrated as a passageway (80). A third passageway (64), contained in the upper portion, vents to the atmosphere by way of an opening (88), thereby providing a source of atmospheric pressure within the chamber (48) when the tap is turned off. The backflow prevention port (60), the backflow prevention passageway (64) and the vent to atmospheric pressure (88) are contiguous as illustrated in the Figures.

In operation, with reference to the Figures, when the taps are turned on hot and/or cold water flow through the vacuum breaker cartridge (31) into the mixing cartridge (32) via the cold water and hot water pipes (34 and 36) respectively. To prevent leakage, the hot and cold water pipes are welded to the cartridge (31) where the pipes (34, 36) and the cartridge (31) meet. Alternatively, the pipes (34, 36) d the cartridge (31) could be integrally formed one around the other. The mixed hot and cold water then enters the vacuum breaker cartridge (31) via fluid entry passageway (62) through an opening (35) in the top of upper portion (44). Fluid entry passageway (62) ends at valve chamber (48) entering the chamber through an opening in the bottom of the chamber, namely, entry port (58).

As the flowing water enters into the chamber (48) via entry port (58) it unseats the float valve (50) pushing the substantially spool-shaped valve upwards until it is seated against the backflow prevention port (60). The water therefore is free to flow into the chamber by way of the entry port (58) and can only exit the chamber by way of the exit port (78). Water is unable to exit the chamber (48) by way of the backflow prevention port (60) because the valve (50) is sealed against the port (60). Water will therefore flow freely through the chamber (48) exiting by way of the exit port (78) and travel through the fluid exit passageway (80) and exit from the cartridge. The fluid exit passageway (80) is connect to the flex hose (38) or other suitable outlet pipe which leads to the spray head (24).

Contained within the chamber (48) is a float valve (50) which is able to freely move between each of two positions. In its normal seated position (the first position) the valve acts to seal the entry port (58). This is illustrated in FIG. 5.

When water is flowing through the chamber (48) the valve (50) is unseated from its first position and it is pushed up to a second position as seen in FIG. 4. In the second position, the valve is secured against the backflow prevention port (60) thereby permitting the flow of water through the chamber (48) and exiting via the exit port (78). When the flow of water stops, the valve (50) drops back to its first position seated over the entry port (58) as seen in FIG. 5.

when the valve (50) is in first position the backflow prevention port (60) is opened allowing air into the chamber (48) by way of the passageway (64) which vents to the atmosphere at opening (88). In a backflow situation contaminated water would reverse-flow up passageway (80) and the chamber (48). Valve (50) would remain seated in its first position thereby sealing the entry port (58). Excess fluid would be free to escape through backflow prevention port (60), along the backflow prevention passageway (64) and exit external to the water supply via an atmospheric vent port (88). Excess fluid will then be free to leak out into the surrounding environment and may escape via openings (92) in the lock nut (90).

By venting the chamber (48) to atmospheric pressure by the opening (88) it is known that the cartridge will act as a vacuum breaker when taps are turned off. This is important since when taps are turned off, it is possible for pressure differentials to accumulate thereby creating possible backflow conditions. The cartridge of the present invention both prevents backflow by a simple and inexpensive means and also prevents the development of pressure differentials and vacuums thereby preventing backflow and backsiphonage of contaminants and pollutants into the potable water supply.

A very useful feature of the present vacuum breaker and/or backflow prevention device is that any type of escutcheon housing may be placed over it providing thereby any of a variety of fashion aspects to it such as those of styling, colour, finish and the like. Thus, inventory for the product of the present invention may be tremendously reduced since one needs only the cartridge or cartridges as described in the present invention over which can be mounted virtually ant type of escutcheon housing. The handle selected may also be one of those generally available which may then be matched with other handles used in the vicinity.

Although preferred embodiments of the invention have been described herein, it will be understood by those skilled in the art that variations, modifications,and equivalents may be made thereto without departing from the spirit of the invention or the scope of the appended claims.

The embodiments of the invention in which an exclusive property or privilege is claimed are defined as follows:

1. A backflow prevention and vacuum breaker device for connection between a potable water supply and a faucet to prevent backflow and back siphoning of contaminated water into a potable water supply, comprising:

a mixing cartridge and a vacuum breaker cartridge, said vacuum breaker cartridge connected to said mixing cartridge and being disposed below said mixing cartridge, said vacuum breaker cartridge having a body having fluid entry means for receiving potable water from said mixing cartridge, fluid exit means for directing potable water towards said faucet, and backflow prevention means located between said fluid entry means and said fluid exit means, said backflow prevention means having a chamber having an entry port contiguous with said fluid entry means, an exit port contiguous with said fluid exit means and a back flow prevention port which is open to atmospheric pressure; and a gravity biased valve disposed in said chamber and movable between a first seated position sealing said entry port and a second raised position sealing said backflow prevention port;

whereby potable water flowing downwardly into said chamber from said mixing cartridge from said fluid entry means is directed upwardly towards said entry port, moving said valve from said first seated position to said second raised position to prevent water leakage through said backflow prevention port thereby permitting potable water to flow through said chamber, out said exit port and along said fluid exit means, and said gravity biased valve returning to said first seated position in the absence of water flow, thereby opening said backflow prevention port, returning said chamber to atmospheric pressure and preventing backflow of contaminated fluid into the potable water supply.

2. A backflow prevention cartridge as claimed in claim 1 whereby said faucet is a kitchen sink faucet.

3. A backflow prevention cartridge as claimed in claim 2 wherein hot and cold water inlet pipes extend through said backflow prevention cartridge to said mixing cartridge.

4. A backflow prevention device and vacuum breaker for a plumbing fixture as claimed in claim 1 wherein the cartridge includes first and second parts which may be disassembled to provide access to the backflow prevention chamber so that the valve body may be serviced.

5. A device for mounting on a plumbing fixture, said device comprising a body having fluid entry means, fluid exit means and backflow prevention means, said backflow prevention means being located between said fluid entry means and said fluid exit means, said backflow prevention means comprising:

a chamber having an entry port contiguous with said fluid entry means, an exit port contiguous with said fluid exit means and a back flow prevention port which is open to atmospheric pressure; and a gravity biased valve mounted to be movable between a first position sealing said entry port and a second position sealing said backflow prevention port;

said fluid entry means being a passageway connecting at least one fluid opening on an exterior of said body to said fluid entry port in said chamber;

wherein said fluid flowing into said chamber through said entry port moves said valve from said first position to said second position thereby permitting fluid to flow through said chamber, out said exit port and along said fluid exit means, wherein said valve, in the absence of fluid flow through said entry port, returns to said first position thereby opening said backflow prevention port to atmospheric pressure to prevent backflow of fluid through said exit port, and wherein hot and cold water inlet pipes extend through said cartridge to a mixing cartridge located above said cartridge and wherein said plumbing fixture is a faucet for a kitchen sink.

6. A device according to claim 5 wherein said hot and cold water is mixed in said mixing cartridge and the mixed water enters said device through a single fluid inlet opening and flows along a single fluid entry passageway to said fluid entry port in said chamber.

7. A backflow prevention device and vacuum breaker for a plumbing fixture as claimed in claim 5 wherein the backflow prevention device is a cartridge adapted to be installed in the plumbing fixture.

8. A backflow prevention device and vacuum breaker for a plumbing fixture as claimed in claim 7 wherein the cartridge includes first and second parts which may be disassembled to provide access to the backflow prevention chamber so that the valve body may be serviced.

9. A backflow prevention device and vacuum breaker for a plumbing fixture as claimed in claim 5 wherein the potable water supplied to the entry port is temperature mixed water supplied from a mixing cartridge installed in the plumbing fixture.

* * * * *